United States Patent [19]

Fiedler

[11] Patent Number: 5,050,506

[45] Date of Patent: Sep. 24, 1991

[54] PALLET

[76] Inventor: Leslie C. Fiedler, Rte. 12, Box 157 C, Bakersfield, Calif. 93312

[21] Appl. No.: 3,634

[22] Filed: Jan. 15, 1987

[51] Int. Cl.[5] ..... B65D 19/38

[52] U.S. Cl. ..... 108/51.1

[58] Field of Search ..... 108/51.1, 51.3, 56.1, 108/57.1

[56] References Cited

U.S. PATENT DOCUMENTS

| | | | |
|---|---|---|---|
| 2,668,681 | 2/1954 | Kappen | 108/51.1 |
| 2,673,052 | 3/1954 | Risch | 108/51.1 X |
| 3,256,839 | 6/1966 | Peterson et al. | 108/56.1 |
| 3,540,385 | 11/1970 | Hobart | 108/51.1 |
| 3,626,860 | 12/1971 | 1Blatt | 108/51.3 |
| 3,717,922 | 2/1973 | Witkowski | 108/901 X |
| 3,940,101 | 2/1976 | Heidelbach | 108/51.3 X |
| 4,485,744 | 12/1984 | Umemura et al. | 108/51.1 |

FOREIGN PATENT DOCUMENTS

| | | | |
|---|---|---|---|
| 2236741 | 7/1975 | France | 108/51.1 |

*Primary Examiner*—Peter A. Aschenbrenner
*Attorney, Agent, or Firm*—Donald D. Mon

[57] ABSTRACT

A pallet for carrying articles stacked upon it formed from a plurality of platform runners which extends parallel to one another along a first axis which define a support plane on which the articles will be rested. A plurality of support runners extend parallel to one another along a second axis defining a base plane on which the pallet will rest. The support runners are disposed on the same side (usually the lower side) of the platform runners with the axes being non-parallel to one another. Adhesives means join the platform runners and the support runners at their intersections. The runners have an axially extending cavity, and there is a rigid closed cell structural foam core which fills these cavities to resist compressive deformation of the foam filled runners by forces exerted on them. The foam filled runners all have substantial resistance to bending forces. Alternatively, the foam filled runner may be considered as a covered foam body.

5 Claims, 1 Drawing Sheet

PALLET

FIELD OF THE INVENTION

This invention relates to a pallet for supporting articles to be stacked thereon.

BACKGROUND OF THE INVENTION

Pallets for storing and transporting manufactured articles are well known. The most familiar example is the fork lift pallet adapted to establish a platform plane on which the articles are supported, and support runners on the lower side to support the platform runners off the ground to enable some carrying item such as the tongue of a fork lift to be inserted beneath it.

Pallets are a well developed art, but have suffered some rather suprising shortcomings, some of which are only recently becoming appreciated. For example, in the storage of food, these pallets are often set on the floor or transported by mechanisms which themselves are not especially clean. They have been the source of some dangerous contamination. The typical wood pallet is not amiable to sterilization because of the porous nature of the wooden material itself, and because of its lack of resistance to sterilizing agents, such as high temperature steam.

Still another disadvantage of the wooden pallet, is its tendency to gain weight from moisture over a period of time. For example, an oak pallet which when it was built weighed about 50 pounds will frequently weigh as much as 100 pounds after substantial exposure to moisture. The cost of fuel for handling the additional weight and the additional burden on persons who must handle the device are evident.

The provision of fork lifts made of materials which can resist sterilizing agents and thereby be sterilized themselves, such as metal pallets, tend to be very expensive and their methods of construction such as by spot welding have not provided sufficiently reliable constructions for the rough usage to which pallets are subjected. In addition, the cost of a metal pallet made entirely of metal and with sufficient cross-section area to resist the forces to be encountered have been prohibitively expensive.

It is an object of this invention to provide a pallet which can be made of relatively expensive materials used in relatively small quantities but which enable the pallet to resist the exerted forces, combined with an assembly technique which is entirely reliable.

BRIEF DESCRIPTION OF THE INVENTION

A pallet according to this invention for carrying articles stacked upon it, comprises a plurality of platform runners which extend parallel to one another along a first axis. They define a support plane on which the articles will be rested. A plurality of support runners extend parallel to one another along a second axis defining a base plane on which the pallet will rest. The support runners are disposed on the same side (usually the lower side) of the platform runners, said axes being non-parallel to one another. Adhesive means join the platform runners and the support runners at their intersections. The runners have an axially extending cavity, and there is a rigid closed cell structural foam core which fills these cavities to resist compressive deformation of the foam filled runners by forces exerted on them. The foam filled runners all have substantial resistance to bending forces. Alternatively, the foam filled runner may be considered as a covered foam body.

According to a preferred but optional feature of the invention, at least some of the runners are made of metal which may be reclaimed aluminum or an alloy primarily of aluminum.

The above and other features of this invention will be fully understood from the following detailed description and the accompanying drawings in which:

DETAILED DESCRIPTION OF THE INVENTION

Figure 1:
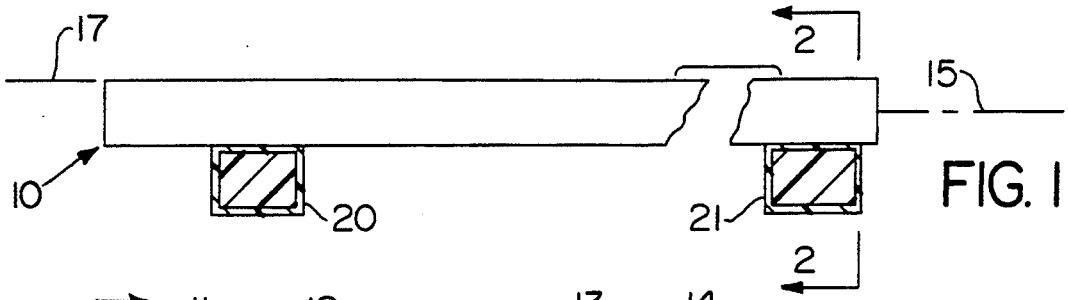
FIG. 1 is a cross-section taken at line 1—1 in FIG. 2.
Figure 2:
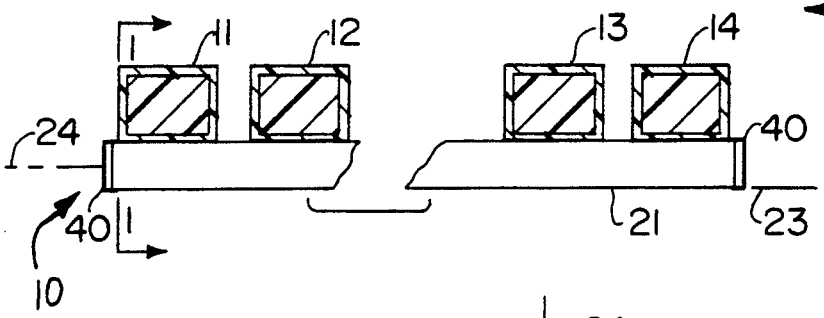
FIG. 2 is a cross-section taken at line 2—2 in FIG. 1.
Figure 3:
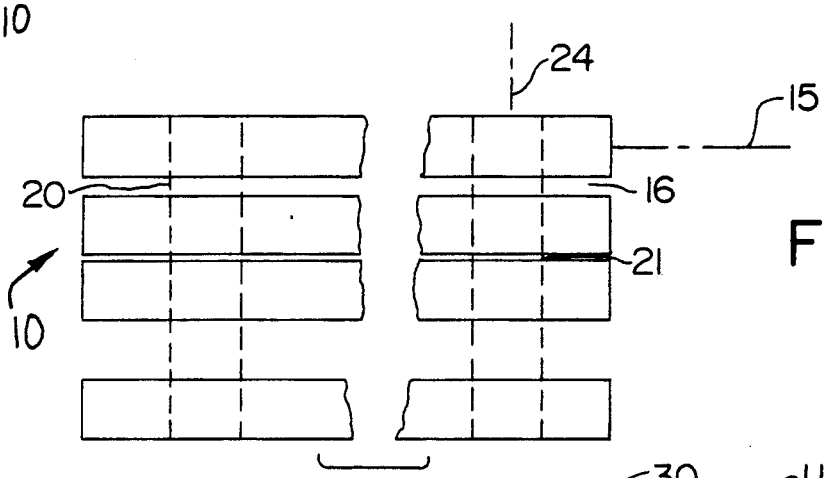
FIG. 3 is a top view of FIG. 1.

The presently preferred embodiment of pallet 10 is shown in FIGS. 1-3. As best shown in FIG. 3, a plurality of platform runners 11, 12, 13, 14 which may be of any desired number extend parallel to one another along a first axis 15. Customarily they will be spaced apart from each other by spacings, such as by spacing 16, so that the pallet can be cleaned. These establish a support plane 17 which is normal to the sheet in FIGS. 1 and 2 and is the sheet in FIG. 3.

A plurality of support runners 20, 21 are placed beneath the platform runners on the same side thereof and they define a base plane 23 which is parallel to and spaced from support planes 17. The support runners extend along a second axis 24 which is non-parallel to the first axis and which when they are overlayed are preferably perpendicular to each other as shown.

In the embodiment of FIGS. 1-3, the runners are all identical so that only runner 11 will be described in detail, but it will be recognized that they can vary from one another. It comprises a preferably rectangular, tubular shell 30 with an axially extending cavity 31 therein. Preferably this is a metal structure which can be formed by rolled, coiled, or composite technique, and has a suitable wall thickness which when supported will give suitable resistance to abrasion and hopefully contribute to resistance to compressive deformation. The cavity is filled by a closed cell structural foam core 32 which is preferably rigid and is fully adherent to the inside wall 33 of the cavity. It will now be seen that the compressive strength of both the tube and of the core are added to provide a very strong compression resistant construction, and that the outer member resists such effects as scouring.

Figure 4:
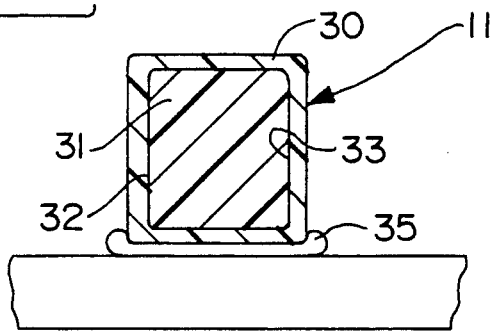
FIG. 4 is an enlarged fragmentary view of an intersection of runners.

Because spot welding techniques are unreliable for such large structures, it has been found that the use of an adhesive 35, as best shown in FIG. 4, is best and is fully suitable. This adhesive may be a thermal set or an x-ray set material such as an epoxy or urethane. It is fully adherent to the outside surfaces of the runners, resistant to the temperatures and material utilized for sterilization, and is forgiving of dimensional variations in the pallet material. The adhesive need not be uniform in its properties. Instead, it might include a foam or fabric layer to provide lateral support or conformation to the respective surface. This adhesive joinder is provided at all the intersections of the runners.

A suitable material for the shell is an aluminum alloy brought to about the 2024T4 composition and condition. A 0.050 inch wall thickness has been found to be adequate. For the platform runners a dimension of ½ inch by 4 inches can be used, in which event the wall thickness may be thinner, perhaps approximately 0.025 inches.

The foam core is preferably cast in place according to known foaming techniques. If desired, caps may be applied to the ends of the tubes.

Figure 5:
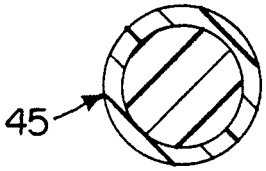
FIG. 5 is a cross-section of another embodiment of runner.
Figure 6:
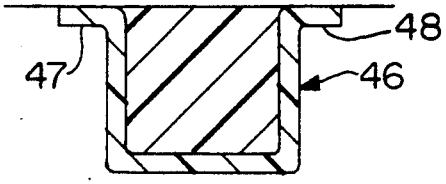
FIG. 6 is a cross-section of still another embodiment of runner.

FIG. 5 shows a foam fulled runner 45 with a circular cross-section. FIG. 6 shows a runner 46 with a hat-shaped section having flanges 47, 48 which may prove to be advantageous in connecting the runners. While metal is a preferred material of construction for the runners, suitably treated cardboards and papers (the term "paper" being generic for this class of material) and plastics are also suitable.

There results a pallet construction which is inexpensive to manufacture. The metal may even be made from reclaimed aluminum cans perhaps beneficiated to a better aluminum alloy condition, although this usually will not be necessary. Should excessive wear develop on the support runners, then a metal shoe may simply be glued to it to provide for additional wear. In every case the material is resistant to entry of water so that the pallet does not gain weight and can be sterilized by live steam or any other technique. The construction is inexpensive and readily manufactured.

This invention is not to be limited by the embodiments shown in the drawings and described in the description which are given by way of example and not of limitation, but only in accordance with the scope of the appended claims.

I claim:

1. A pallet for carrying articles stacked upon it, said pallet comprising:

a plurality of platform runners extending parallel to one another along a first axis and defining a support plane;

a plurality of support runners extending parallel to one another along a second axis abutting said platform runners, defining a base plane, said support runners being disposed on the same side of the platform runners, said axes being non-parallel to one another;

adhesive means joining said platform runners and support runners at their intersection;

said runners having an external shell made of an impermeable, non-absorptive material with an internal wall at least partially bounding an axially extending cavity; and a cast-in-place closed cell structural foam core completely filling each said cavity and self-adhered to the entire said internal wall to form a unitary monolithic structure, whereby said runner is capable of resisting substantial compressive deformation, said foam filled runners also having substantial resistance to bending forces, and the capability to exclude liquids and not to absorb them.

2. A pallet according to claim 1 in which the shells of the runners are tubular, with a substantially constant lateral cross-section.

3. A pallet according to claim 2 in which at least some of said shell are made of metal.

4. A pallet according to claim 3 in which said metal is aluminum or an alloy primarily of aluminum.

5. A pallet according to claim 2 in which at least some of said runners are made of paper treated to be impermeable to liquids.

* * * * *